US008747009B2

(12) United States Patent
Lee

(10) Patent No.: US 8,747,009 B2
(45) Date of Patent: Jun. 10, 2014

(54) ORAL CARE IMPLEMENT

(75) Inventor: David K. Lee, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 490 days.

(21) Appl. No.: 13/072,873

(22) Filed: Mar. 28, 2011

(65) Prior Publication Data

US 2011/0239388 A1 Oct. 6, 2011

Related U.S. Application Data

(60) Provisional application No. 61/319,675, filed on Mar. 31, 2010.

(51) Int. Cl.
*A46B 17/04* (2006.01)

(52) U.S. Cl.
USPC ..... 401/269; 15/167.1

(58) Field of Classification Search
USPC ..... 401/268, 269, 132, 133; 15/167.1
See application file for complete search history.

(56) References Cited

U.S. PATENT DOCUMENTS

| | | | | |
|---|---|---|---|---|
| 816,793 | A | 4/1906 | Harris | |
| 1,411,681 | A * | 4/1922 | Burlew | 424/49 |
| 1,779,018 | A | 10/1930 | Smallwood et al. | |
| 1,811,833 | A * | 6/1931 | Simon | 401/132 |
| 1,995,374 | A * | 3/1935 | Young | 401/268 |
| 2,262,982 | A * | 11/1941 | Wolcott | 15/167.1 |
| 2,307,493 | A * | 1/1943 | Davidson | 401/268 |
| 2,728,932 | A | 1/1956 | Ramsey, Sr. | |
| 2,917,057 | A | 12/1959 | Busseuil | |
| 3,165,776 | A | 1/1965 | Tuseth | |
| 3,316,580 | A * | 5/1967 | Tebbs | 401/132 |
| 3,536,410 | A | 10/1970 | Wargoe | |
| 3,964,122 | A | 6/1976 | Kurdy | |
| 4,384,382 | A * | 5/1983 | Diamant | 15/104.001 |
| 4,844,641 | A * | 7/1989 | Grosfilley et al. | 401/176 |
| 4,866,809 | A | 9/1989 | Pelletier | |
| 5,139,142 | A * | 8/1992 | Simon | 206/362.3 |
| 5,184,719 | A * | 2/1993 | Gordon | 206/209.1 |
| 5,475,891 | A | 12/1995 | Rickey | |
| 5,513,411 | A | 5/1996 | Simon | |

(Continued)

FOREIGN PATENT DOCUMENTS

| | | |
|---|---|---|
| FR | 2772569 | 6/1999 |
| FR | 2772571 | 6/1999 |
| WO | WO 2009/136911 | 11/2009 |

OTHER PUBLICATIONS

International Search Report and Written Opinion in International Application No. PCT/US11/030135 mailed Jul. 6, 2011.

*Primary Examiner* — David Walczak
*Assistant Examiner* — Jennifer C Chiang
(74) *Attorney, Agent, or Firm* — Ryan M. Flandro

(57) ABSTRACT

An oral care implement having a dispenser containing oral care material and a moisture impermeable barrier. An oral care implement comprising: a handle; a head connected to the handle, the head comprising at least one tooth cleaning element extending from a face of the head; a dispenser containing an oral care material positioned on the head, the dispenser being degradable when subjected to moisture; a removable barrier attached to the head so as to create a chamber between an inner surface of the removable barrier and a portion of the head, the removable barrier being constructed of a moisture impermeable material; and wherein the dispenser is disposed within the chamber.

22 Claims, 5 Drawing Sheets

(56) References Cited

U.S. PATENT DOCUMENTS

| | | | | |
|---|---|---|---|---|
| 5,915,868 | A * | 6/1999 | Frazell | 401/132 |
| 6,004,059 | A * | 12/1999 | Zaccaria | 401/268 |
| 6,056,469 | A * | 5/2000 | Algorri | 401/269 |
| 6,135,274 | A * | 10/2000 | James | 206/209.1 |
| 6,213,662 | B1 | 4/2001 | Aljanedi | |
| 6,536,979 | B1 | 3/2003 | Kenny et al. | |
| 7,182,542 | B2 * | 2/2007 | Hohlbein | 401/268 |
| 7,234,192 | B2 | 6/2007 | Barbar | |
| 7,287,643 | B1 * | 10/2007 | Glover, Sr. | 206/63.5 |
| 7,309,185 | B2 | 12/2007 | Thorpe et al. | |
| 7,431,530 | B1 * | 10/2008 | Powers | 401/291 |
| 7,575,387 | B2 * | 8/2009 | Atkin | 401/268 |
| 8,109,686 | B2 * | 2/2012 | Bartschi et al. | 401/282 |
| 2003/0019063 | A1 | 1/2003 | Abraham | |
| 2004/0170464 | A1 | 9/2004 | Polczynski | |
| 2004/0237226 | A1 | 12/2004 | Hohlbein et al. | |
| 2004/0250363 | A1 | 12/2004 | Hsu | |
| 2008/0202960 | A1 * | 8/2008 | Donohue | 206/362.3 |
| 2009/0123217 | A1 | 5/2009 | Ross | |

* cited by examiner

ORAL CARE IMPLEMENT

CROSS-REFERENCE TO RELATED APPLICATIONS

This application claims the benefit of U.S. Provisional Application No. 61/319,675, filed on Mar. 31, 2010. The disclosure of the above application is incorporated herein by reference.

FIELD OF THE INVENTION

The present invention relates generally to oral care implements, and, more particularly, to oral care implements which have a moisture degradable dispenser containing an oral care material.

BACKGROUND OF THE INVENTION

The advantages of good dental hygiene are well known. Often, however, people either forget their toothbrushes when traveling or do not carry their toothbrushes outside of the home. Hotels, health care facilities, nursing homes, hospitals, daycare facilities, schools, airlines, etc. have a need for single use disposable or limited multiple use toothbrushes that may be economically supplied to and discarded by individuals without a toothbrush, a dentifrice and/or a water supply. Such toothbrushes could be used in vending machines or distributed in large quantities for simple, portable use from anywhere.

Various types of disposable, limited use or portable toothbrushes are known in the art. For example, some toothbrush systems have attempted to meet some of these needs by providing toothpaste within the toothbrush itself, through an integrated channel, for distribution through the toothbrush and around the bristles. This approach tends to be economically inefficient due to added manufacturing costs. In addition, the toothpaste in some of these integrated channel toothbrushes has a tendency to become dry, hard and stale. Furthermore, these toothbrushes require water in order for the toothpaste to have maximum effectiveness and for the user to clean up after a tooth brushing session.

SUMMARY OF THE INVENTION

The present invention is directed to an oral care implement that comprises a dispenser containing an oral care material. The dispenser is designed to degrade when subjected to a user's saliva so that the oral care material is released into the oral cavity of the user. While designing the dispenser to degrade when subjected to saliva allows the inventive oral care implement to be used without water, the dispenser will also have a tendency to degrade prematurely if accidentally subjected to water or to a high humidity environment, thereby resulting in the oral care implement being ruined for its intended purpose. Thus, according to the present invention, the oral care implement further comprises a cap that creates an air-tight chamber between a head of the oral care implement and an inner surface of the cap in which the dispenser is located.

In one aspect, the invention is an oral care implement comprising: a handle; a head connected to the handle; a plurality of tooth cleaning elements extending from a face of the head; a dispenser containing an oral care material, the dispenser being degradable when subjected to moisture; a removable cap attached to the head such that an inner surface of the cap and a portion of the head forms an air-tight chamber; and wherein the dispenser is disposed within the air-tight chamber.

In another aspect, the invention can be an oral care implement comprising: a handle; a head connected to the handle; a plurality of tooth cleaning elements extending from a face of the head; a dispenser containing an oral care material, the dispenser being degradable when subjected to moisture; a removable cap attached to the head such that an inner surface of the cap and a portion of the head forms an air-tight chamber, the air-tight chamber containing a low humidity atmosphere; and wherein the dispenser is disposed within the low humidity atmosphere of the air-tight chamber.

In a further aspect, the invention can be an oral care implement comprising: a handle; a head connected to the handle; a plurality of tooth cleaning elements extending from a face of the head; a dispenser containing an oral care material disposed on the head; a removable cap attached to the head and covering the dispenser; and wherein the dispenser and the cap are surrounded by the plurality of tooth cleaning elements.

In a yet another aspect, the invention can be a method of assembling an oral care implement for distribution comprising: providing an oral care implement comprising a handle and a head connected to the handle and a plurality of tooth cleaning elements extending from a face of the head; providing a dispenser containing an oral care material on the head of the oral care implement, the dispenser being degradable when subjected to moisture; and attaching a removable cap to the head in a low humidity atmosphere such that an inner surface of the cap and a portion of the head forms an air-tight chamber, the air-tight chamber filled with the low humidity atmosphere and the dispenser disposed within the air-tight chamber.

In a yet further aspect, the invention can be an oral care implement comprising: a handle; a head connected to the handle, the head comprising at least one tooth cleaning element extending from a face of the head; a dispenser containing an oral care material positioned on the head, the dispenser being degradable when subjected to moisture; a removable barrier attached to the head so as to create a chamber between an inner surface of the removable barrier and a portion of the head, the removable barrier being constructed of a moisture impermeable material; and wherein the dispenser is disposed within the chamber.

In an even further aspect, the invention can be an oral care implement comprising: a handle; a head connected to the handle, the head comprising at least one tooth cleaning element extending from a face of the head; the at least one tooth cleaning element comprising an oral care material; a removable barrier attached to the head so as to create a chamber between an inner surface of the removable barrier and a portion of the head, the removable barrier being constructed of a moisture impermeable material; and wherein the at least one tooth cleaning element is disposed within the chamber.

BRIEF DESCRIPTION OF THE DRAWINGS

The present invention will become more fully understood from the detailed description and the accompanying drawings, which are provided for understanding only and are not to be considered limiting of the present invention.

DETAILED DESCRIPTION OF THE DRAWINGS

In the following description, the invention is discussed in terms of a manual toothbrush. However, the invention is not so limited. In other embodiments, the invention can be in the form of other types of oral care implements, including without limitation, a soft-tissue cleansing implement, an interproximal pick, a flossing tool, a plaque scraper, a powered toothbrush, or any another type of ansate implement designed for oral care use. It is also to be understood that, irrespective of the exact type of oral care implement utilized, various structural and functional modifications and/or additions may be made without departing from the scope of the present invention.

Figure 1:
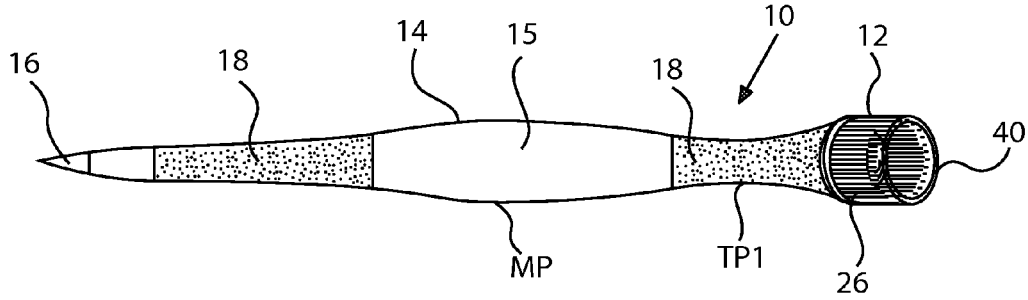
FIG. 1 is a front view of an oral care implement in accordance with an embodiment of the present invention.
Figure 2:
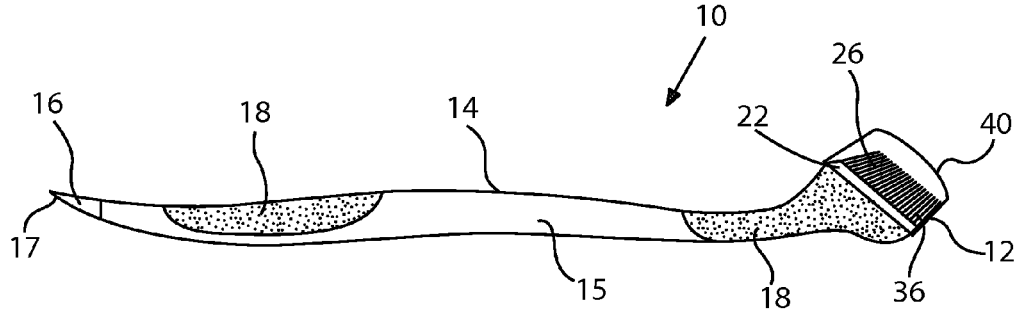
FIG. 2 is a right-side view of the toothbrush of FIG. 1.
Figure 3:
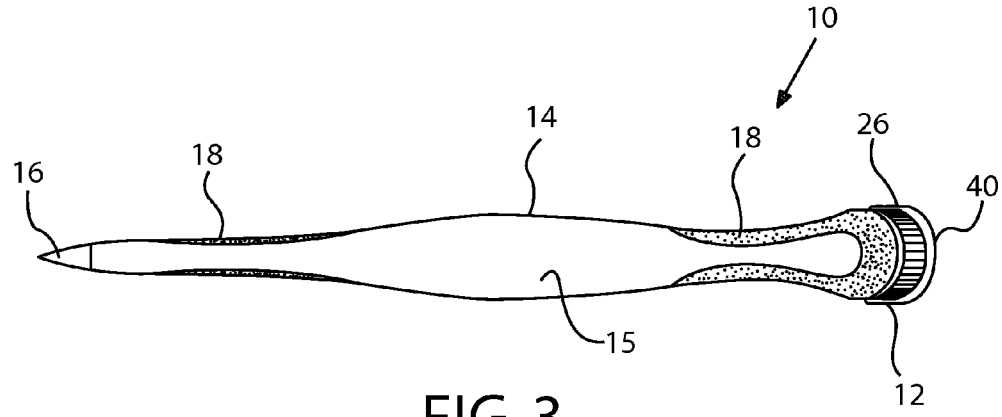
FIG. 3 is a rear view of the toothbrush of FIG. 1.

Referring first to FIGS. 1-3, an oral care toothbrush 10 according to one embodiment of the present invention is illustrated. The oral care toothbrush 10 generally comprises a head 12, a handle 14, and a removable cap 40 attached to the head 12. The head 12 may either be a refill head that is removably connected to the handle 14 or a structure that is permanently connected to the handle 14. The majority of the handle 14 and a portion of the head 12 may be molded from a variety of rigid materials, including without limitation plastics, resins and the like. One especially suitable rigid material is polypropylene.

In the illustrated embodiment, the proximal end 17 of the handle 14 comprises an oral care accessory, which in the exemplified embodiment is a toothpick 16. The toothpick 16 is preferably formed of a resilient and soft thermoplastic elastomer. As with the head 12, the toothpick 16 may be a refill toothpick that is removably connected to the handle 14 or may be permanently connected to the handle 14. The toothpick 16 provides a mechanism for spot cleaning between teeth. Forming the toothpick 16 of a soft thermoplastic elastomer provides for a more comfortable interproximal cleaning between the teeth. However, the toothpick 16 could be made of a stiff rigid material, similar to the main portion of the handle 14. The toothpick 16 could simply be adhered to or otherwise mounted to the end of the handle 14. Alternatively, it may be integrally formed therewith. Furthermore, a different accessory, such as a strip of dental floss or a tongue cleaning element, may be attached to the proximal end 17 of the handle 14 instead of (or in addition to) the toothpick 16. In certain embodiments, the handle 14 may not include an accessory or may include multiple accessories.

Portions 18 of the handle 14 are preferably formed of a resilient and soft thermoplastic elastomer. A suitable thermoplastic elastomer includes a thermoplastic vulcanate (TPV) consisting of a mixture of polypropylene and EPDM (ethylene propylene diene monomers), which is available under the tradename SANTOPRENE™ and described in U.S. Pat. No. 5,393,796. Another suitable TPV consisting of a mixture of polypropylene and natural rubber, sold under the tradename VYRAM™, can also be used. Both SANTOPRENE™ and VYRAM™ are elastomers marketed by Advanced Elastomer Systems. Other suitable elastomers include KRATON, a brand of styrene block copolymer (SBC) marketed by Shell, and DYNAFLEX G 2706 (brand), a thermoplastic elastomer marketed by GLS Corporation and which is made with KRATON (brand) polymer. Of course, the invention is not limited to any specific type of thermoplastic elastomer.

The handle 14 may further include dimples, bumps, or ridges protruding from portions of its outer surface. Such features not only provide a decorative appearance to the handle 14 but can also facilitate enhanced gripping of the handle 14 during use of the oral care toothbrush 10. The dimples may be formed from the same material as the soft elastomer portions 18 of the handle 14 or from the same material as the remaining portions of the handle 14 (e.g., a rigid material such as polypropylene). All or part of the handle 14 could be made of any suitable material, such as plastic, wood, metal or various natural materials which are biodegradable. Preferably, the handle 14 has a generally flat or oval transverse cross-sectional shape, rather than a circular cross-sectional shape, in its gripping portion 15. The gripping portion 15 is the longitudinal section of the handle 14 that is located between the elastomer portions 18. The shape of the handle 14, and specifically the shape of the gripping portion 15, facilitates an enhanced gripping of the handle 14 by the user. For example, the toothbrush 10 may gradually increase in width from a point TP1 in the elastomer portion 18 nearest the head 12 to a middle point MP of the gripping portion 15 and then gradually decrease in width from the middle point MP to the proximal end 17 of the handle 14 (best shown in FIG. 1). The gradual increase and decrease of the width of the handle 14 may be constant or may vary depending on the desired grip. In other embodiments, the width of the handle 14 may be constant.

The toothbrush 10 also includes a cap 40 that is attached to the head 12. The cap 40 is preferably made of a hard thermoplastic, such as polypropylene, but can be made from a wide range of materials. The cap 40 is preferably constructed of a transparent rigid plastic material so that the head 12 is visible therethrough. Of course, translucent or opaque materials can be used. The purpose of the cap 40, as well as the details of its structure, will be described in greater detail below with respect to FIGS. 5-9.

Referring still to FIGS. 1-3, in one preferred embodiment of the present invention, the entire structure of the toothbrush 10, including the head 12, the handle 14, and the toothpick 16, is molded as one integral structure, using a conventional two-component injection molding operation typically used in the manufacture of toothbrushes. This enables the toothbrush 10 to be economically and quickly manufactured. Although the toothbrush 10 may be constructed in wide variety of sizes, shapes and relative dimensions, it is preferred that the toothbrush 10 have a small profile so that it is easily portable and can be discretely used. In one embodiment, it is preferred that the head 12 be small enough to cover a single tooth at a time and that the handle 14 be substantially thinner than conventional, everyday toothbrush handles. Furthermore, in certain embodiments, the cap 40 will be preferably sized so that its outer diameter (or width) is equal to or less than the diameter (or width) of the head 12. Additionally, it may also be preferred that the cap 40 have a height that is substantially equal to (or slightly greater) than the height of the tooth cleaning elements 26 (measured from the surface of the head 12). Of course, the invention is not so limited in all embodiments.

Since the toothbrush 10 is intended to be both small and lightweight, it is preferred that the toothbrush 10 weigh no more than 3 grams in certain embodiments. The small size allows the toothbrush 10 to be held completely within the palm of an adult user's hand. The head 12 is preferably sized to correspond to the size of an individual tooth or an individual tooth and the interproximal areas. While the head 12 could be made in any suitable shape, it is preferably of a circular or oval shape and has a maximum lateral dimension or diameter of no greater than 13 mm, preferably no greater than 12 mm and most preferably no greater than 11 mm. The cap 40 is also preferably of a circular or oval shape (as measured across its transverse cross-section) and corresponds to the shape and size of the head 12. Of course, the invention is not limited to any specific dimensions or shapes.

Referring solely now to FIG. 2, the head 12 is oriented so that an outer surface 36 of the head 12 is at an acute angle to a longitudinal axis of the handle 14. More specifically, the acute angle is formed between a reference line that is substantially coextensive with the outer surface 36 of the head 12 that terminates at a point of intersection with the longitudinal axis and a portion of the longitudinal axis that extends from the point of intersection toward the proximal end 17 of the handle 14. The acute angle is preferably in a range of 20 degrees to 70 degrees and most preferably in a range of 30 degrees to 60 degrees. The tooth cleaning elements 26 could extend perpendicular to the outer surface 36 of the head 12 or could extend at a non-normal angle to the outer surface 36 of the head 12. In one embodiment, the cleaning elements 26 could extend from the outer surface 36 of the head 12 at an angle in a range of 60 degrees to 90 degrees, or in the range of 75 degrees to 90 degrees. Of course, the invention is not limited to any particular configuration.

Figure 4:
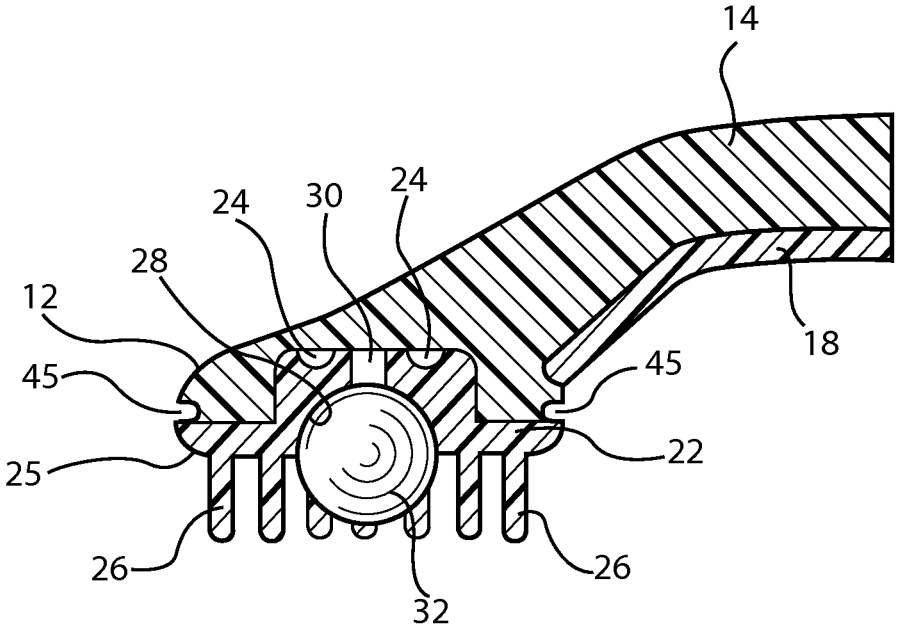
FIG. 4 is a cross-sectional schematic of the head portion of the oral care implement of FIG. 1 in accordance with an embodiment of the present invention.

Referring now to FIG. 4, the head 12 comprises a bristle or cleaning element block 22. In certain embodiments, it is preferred that cleaning element block 22 be formed of a resilient and soft thermoplastic elastomer, such as the thermoplastic elastomers discussed above with respect to the elastomer portions 18 of the handle 14. The cleaning element block 22 includes a socket 28 which holds a dispenser 32 containing an oral care material. The cleaning element block 22 may also include one or more depressions 24 and an opening 30 that provides a cushioning effect to the dispenser 32. In the exemplified embodiment, the dispenser 32 is in the form of a capsule, which is preferably a gel capsule. The cushioned socket 28, the opening 30 and the cleaning element block 22 help prevent the dispenser 32 from becoming physical damaged and possibly rupturing prior to use of the toothbrush 10. The cap 40 provides further physical protection when attached to the head 12.

Any suitable oral care material could be housed within and dispensed from the dispenser 32. Such products include, without limitation, toothpaste, tooth powder, or a small vial of mouthwash having a gel, a powder or a liquid. Such a vial could be separately included in a package containing the toothbrush. The materials could be flavored and could be provided in sets of different flavors and/or different characteristics such as medicaments, numbing materials and the like. In embodiments where the dispenser 32 is in the form of a bead or gel capsule, different colors may be used to correlate the bead or gel capsule with a flavor of the oral care material contained therein in order to enhance consumer appeal. Preferably, the oral care material is a fluidic oral care material.

Of course, the dispenser 32 can take the form of a wide variety of embodiments, including a coating on the tooth cleaning elements 26 of the cleaning block 22, a tablet, a film matrix/flakes in the bristle field, or any other type of barrier that controls release of the oral care material.

In certain embodiments, the materials making up the dispenser 32 and the oral care material contained therein are preferably consumable by the user of the toothbrush 10, eliminating the need for water, a sink, or a waste receptacle to expectorate the dispenser 32 or its contents. Preferably, the toothbrush 10 is supplied with a single, non-replaceable and non-refillable dispenser 32 so as to be easily transported, used and economically disposed of.

The cleaning block 22 includes a plurality of tooth cleaning elements 26 that are integrally formed with and extend outwardly from an outer surface 25 of the cleaning element block 22. In the illustrated embodiment, all of the tooth cleaning elements 26 extend outwardly from the outer surface 25 of the head 12 an equal distance so that their distal ends collectively form a generally flat surface. Alternatively, however, some of the tooth cleaning elements 26 may be shorter or longer than others of the tooth cleaning elements 26.

The term "tooth cleaning elements" as used herein is intended to be used in a generic sense, including cleaning elements or massaging elements. The cleaning elements can be arranged in a circular cross-section shape or any type of desired shape, including straight portions or sinusoidal portions. It is to be understood that the illustrated pattern of the cleaning elements 26 is merely for exemplary purposes. The invention can be practiced with various combinations of the same or different configurations (such as stapled or in-mold tufting (IMT) bristle technology as disclosed in U.S. Pat. Nos. 5,609,890, 5,390,984, and 5,533,791, the disclosures of which are incorporated herein by reference in their entireties, etc.). The cleaning elements can be formed of the same or different bristle materials (such as nylon bristles, spiral bristles, rubber bristles, or the like). Similarly, while FIGS. 1-4 illustrate the tooth cleaning elements 26 to be generally perpendicular to the outer surface of the cleaning element block 22, some or all of the tooth cleaning elements 26 may be angled with respect to the outer surface 25 of the cleaning element block 22 and/or to each other. Different combinations of configurations, materials, and orientations may be selected to achieve a specific intended result, such as enhanced cleaning, tooth polishing, breath freshening, tooth whitening and/or massaging of the gums.

The tooth cleaning elements 26 could be conventional filament bristles, elastomeric bristles or fingers, or any combination of materials so as to provide the proper stiffness in an economical manner. For example, in preferred embodiments, the tooth cleaning elements 26 can be constructed of a flexible resilient material, such as TPE, and a lesser expensive material, such as LLDPE (linear low density polyethylene) or EVA (ethylene vinyl acetate). The tooth cleaning elements 26 may also be constructed of a blend of TPE and either LLDPE, EVA, or polypropylene. Preferably, the two materials are combined to create cleaning elements 26 having a stiffness of less than 600 MPa. The blend of materials would give the tooth cleaning elements 26 the same properties as that of conventional nylon bristles, while offering reduced costs. For example, there would be lower manufacturing costs by injection molding instead of conventional bristle tufting. Alternatively the resilient material could be a single material, such as hard TPE (i.e. Shore A 80 hardness), LLDPE or EVA.

The tooth cleaning elements 26 could be hollow, such as hollow bristles, which are capable of absorbing a medicament by capillary action. Such practice of the invention would be particularly useful for children where a medicament, such as an antibacterial material, or some form of flavor could be dispensed from the hollow cleaning elements. In such an embodiment, the tooth cleaning elements 26 themselves would act as the dispenser containing the oral care material. When the tooth cleaning elements 26 act as the dispenser, the tooth cleaning elements 26 may comprises a coating or layer that acts as a seal that degrades when exposed to moisture in certain embodiments.

Figure 6:
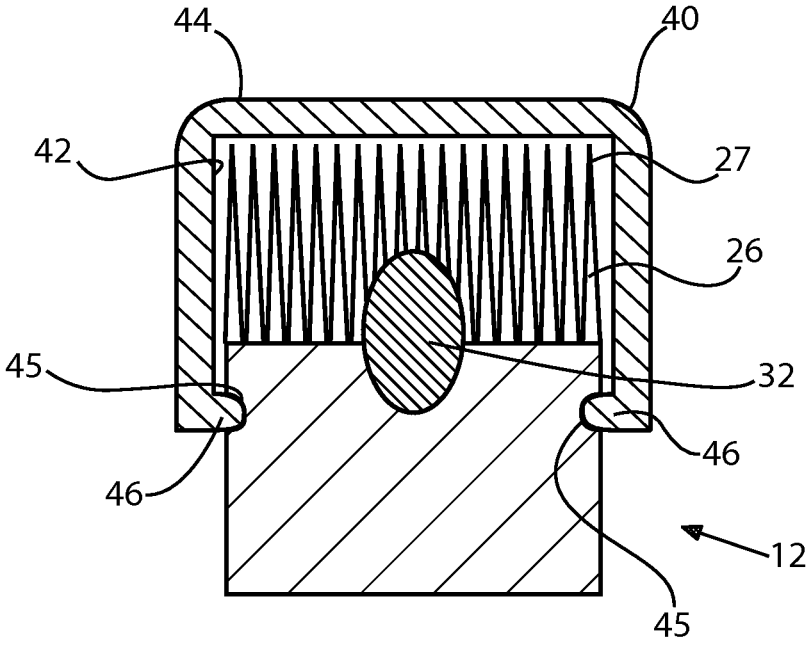
FIG. 6 is a cross-sectional schematic of a head portion of an oral care implement with a cap attached thereto in accordance with a first embodiment of the present invention.

The tooth cleaning elements 26 may be of any desired shape. For example, the tooth cleaning elements 26 could be of cylindrical in shape and have a uniform diameter throughout their length. Alternatively, the tooth cleaning elements 26 could taper from the root where they extend from the head 12 to their outer cleaning ends or tips 27 (FIG. 6). Because a preferred practice of the invention is to provide a small lightweight toothbrush, the dimensions of the various components of the toothbrush 10 are preferably small (as compared to traditional toothbrushes). Thus, for example, each tooth cleaning element 26 may extend outwardly from the outer surface of the cleaning block 22 a distance no greater than 10 mm and preferably no greater than 8 mm and most preferably no greater than 6 mm. When tapered cleaning elements are used, the root diameter should be no greater than 1.5 mm, more preferably between 0.5 mm and 1 mm and most preferably no greater than 0.3 mm. The diameter could then decrease in size to no greater than 0.2 mm at a distance of no greater than 6 mm from the base of the tooth cleaning element 26. The taper of the diameter at a distance above the root diameter could be a range of no greater than 1 mm at a distance of no greater than 10 mm, preferably no greater than 0.6 mm at a distance of no greater than 8 mm and most preferably no greater than 0.2 mm at a distance of no greater than 6 mm. Preferably, the length of the entire toothbrush 10 is no greater than 5 inches, more preferably no greater than 4 inches and most preferably in the range of 2 to 4 inches.

Still referring to FIG. 4, and as stated above, the cleaning element block 22 may include one or more depressions 24 which are designed to receive and provide a cushioning effect to an oral care dispenser 32, such as the rupturable gel capsule. The one or more depressions 24 can be varied in size so as to accommodate not only varying size dispensers 32, but varying quantities of toothpowder, toothpaste, tooth cleaning gel dentifrice or other oral care materials.

The tooth cleaning elements 26 define a cleaning field in the head 12 and the dispenser 32 is preferably mounted within this cleaning field. Of course, the invention is not so limited. The tooth cleaning elements 26 preferably extend outwardly from the cleaning block 22 to be approximately flush with the outer surface of the dispenser 32. Alternatively, the tooth cleaning elements 26 may extend slightly further than the dispenser 32.

The dispenser 32 holds and applies an oral care solution onto the tooth cleaning elements 26 of the toothbrush head 12. As mentioned above, the oral care solution may be toothpaste, a gel, a mouthwash, or a similar dentifrice or oral hygiene product, or a combination of the same. Preferably, the dispenser 32 is a liquid-filled gel capsule having a shell comprising frangible, thin walls that easily rupture or burst when rubbed against the teeth. In a preferred embodiment, the dispenser 32 degrades when subjected to moisture and, thus, dissolves when mixed with the saliva of a user. As the saliva of a user degrades and dissolves the walls of the dispenser 32, the oral care solution held therein is excreted. While the degradation of the dispenser 32 is a desired characteristic for effectuating end use of the toothbrush 10 by the consumer, the moisture-driven degradation of the dispenser 32 presents issues with respect to properly preserving the integrity of the dispenser during product manufacturing, packaging, shipping, and display in retail stores. The dispenser 32, or at least a portion thereof, is susceptible to degradation when subjected not only to direct contact with liquid water but also to prolonged exposure to atmospheres having a high humidity level. It has been discovered that a high humidity environment can degrade the integrity of the dispenser 32 and prematurely expel the oral care material or cause the oral care material to dry up. Of course, the exact humidity levels and exposure times that will result in the degradation of the dispenser will be determined on a case-by-case basis, considering such factors as the type of dispenser being used, the type of oral care material, and the thermal cycling to which the toothbrush 10 is subjected. In view of the foregoing, the dispenser 32 is covered with the cap 40 that forms an air-tight chamber in which the dispenser 32 is disposed, thereby protecting the dispenser 32 from external moisture which can be in the form a high humidity atmosphere or liquid water.

Still referring to FIG. 4, the head 12 of the toothbrush 10 is provided with an annular groove 45 that is formed into the peripheral surface of the head 12. In the exemplified embodiment, the groove 45 is formed into the rigid portion of the directly adjacent to (and below) the elastomeric cleaning element block 22. In this fashion, the elastomeric cleaning element block 22 can form a gasket-type fit with the cap 40, thereby creating an air-tight annular seal, while the rigid portion of the head 12 structurally secures the cap 40 in place. In alternative embodiments, the annular groove 45 may be formed directly into the elastomeric cleaning element block 22 itself, may be located entirely in the rigid plastic of the head 12, or may be formed into the outer surface 25 of the head 12.

In the exemplified embodiment, when the cap 40 is attached to the head 12, the elastomeric cleaning element block 22 will be compressed between the inner surface of the cap 40 and the head 12, thereby creating the air-tight seal. The air-tight seal protects the dispenser 32 from premature moisture exposure because the dispenser 32 (whatever form it takes) will be located within the air-tight chamber (which is also a water-tight chamber) formed by the cap 40 and the head 12. Although FIG. 4 illustrates the connection mechanism for the cap 40 to be an annular groove 45, the invention is not so limited and many different type of groove/ridge configurations, gasket assemblies, tight-fit assemblies, snap-fit assemblies, threaded connections, or combinations thereof are contemplated and are considered within the scope of the present invention.

As noted above, the dispenser 32 is susceptible to degradation when subjected to moisture, whether it be direct liquid contact or prolonged exposure to a high humidity environment or atmosphere. This may be because the dispenser 32 is water soluble in certain embodiments. Stated simply, the cap 40 provides a small discrete structure that creates a stabilized low humidity environment in which the dispenser 32 resides.

Figure 5:
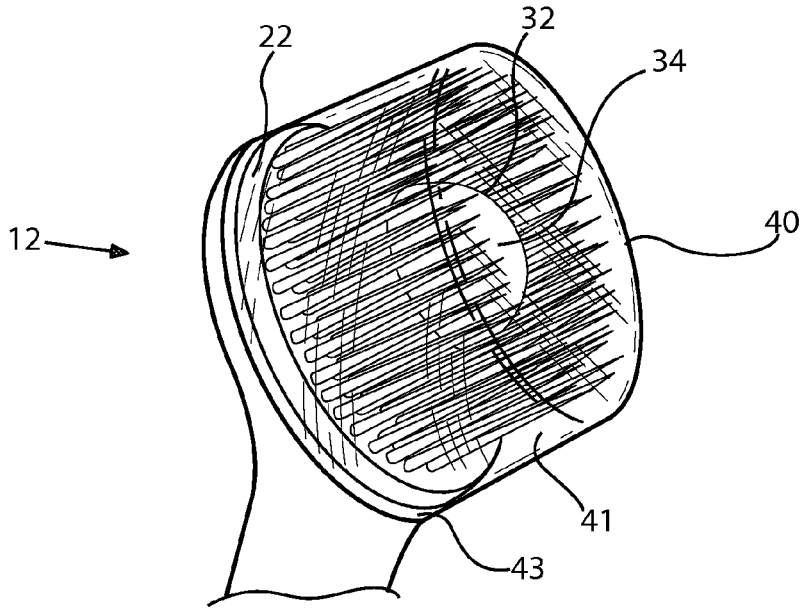
FIG. 5 is a close-up view of the head portion of the oral care implement of FIG. 1 with the cap connected thereto in accordance with an embodiment of the present invention.
Figure 5A:
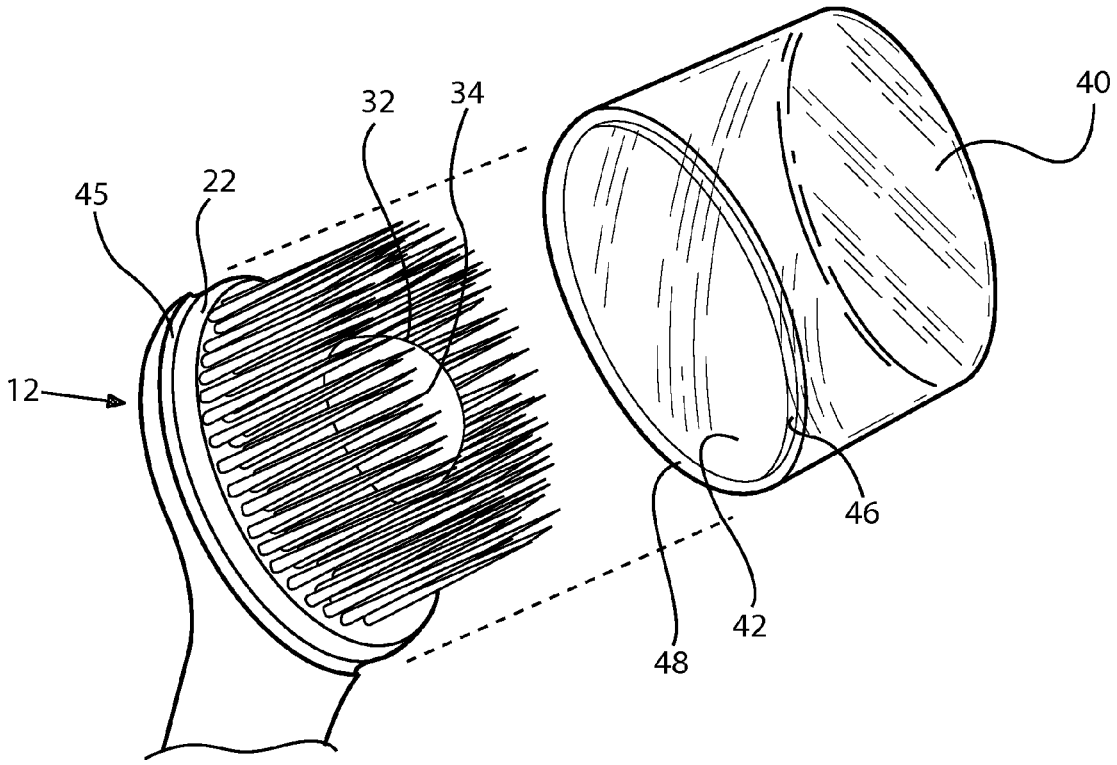
FIG. 5A is a close-up view of the head portion of the oral care implement of FIG. 1 with the cap removed therefrom in accordance with an embodiment of the present invention.

Referring now to FIGS. 5 and 5A concurrently, the head 12 of the toothbrush 10 (which contains the dispenser 32) is illustrated with the cap 40 in an assembled state (FIG. 5) and a disassembled state (FIG. 5A). In a preferred embodiment, the dispenser 32 is a gel capsule that has a seal 34 (in the form of a shell or outer layer or coating) that degrades when subjected to moisture, whether it be direct contact with a liquid or a high humidity environment. As discussed above, the dispenser 32, which is protected by the cap 40 in the assembled state, can take on a wide variety of structural forms, as can the moisture sensitive (i.e., moisture degradable and/or water soluble) seal 34 which preserves (and eventually disperses) the oral care material during use.

When the cap 40 is attached to the head 12, as shown in FIG. 5, the dispenser 32 is protected from the external atmosphere, which can be a high humidity environment, because an air-tight seal is formed between the cap 40 and the head 12. As a result, the dispenser 32 is surrounded by the internal atmosphere of the cap chamber 41, the humidity level of which is dictated during manufacturing/assembly. Stated simply, the air/gas filling the internal chamber 41 formed by the cap 40 and the head 12 has a low humidity content.

The air-tight chamber 41 is formed by an inner surface 42 of the cap 40 and a portion of the head 12. Preferably, the cap 40 is attached to the head 12 while the entire toothbrush 10 is in an atmosphere having a humidity level that is sufficiently low so as not to degrade the dispenser 32 despite a prolonged exposure. As such, the attachment between the cap 40 and the head 12 will trap the low humidity air into the air-tight chamber 41. A suitably low humidity atmosphere is one which has a relative humidity level that is less than 70% at room temperature, preferably less than 60% at room temperature, more preferably less than 50% at room temperature, and most preferably less than 40% at room temperature. Furthermore, in certain embodiments, even if an atmosphere having a higher humidity is initially trapped within the chamber 41, the dispenser 32 may be able to absorb this small set amount of moisture without degrading. To this extent, the air-tight nature of the chamber 41 will prevent further exposure of the dispenser 32 to moisture and, thus, will keep the dispenser 32 in tact.

With reference to FIG. 5, in the exemplified embodiment, the attachment of the cap 40 to the head 12 of the toothbrush 10 creates an air-tight annular seal 43 between the inner surface 42 of the cap 40 and a periphery of the head 12. The air-tight annular seal 43 can be formed by the mating between an annular ridge 46 (FIG. 5A) of the cap 40 and the annular groove 45 of the head 12 of the toothbrush 10. Of course, the annular seal 43 can be formed in a variety of other manners, some of which are discussed below with respect to FIGS. 6-9 (or discussed above with respect to FIG. 4). Furthermore, the location of the groove 45 on the head 12 and the ridge 46 on the cap 40 can be interchanged such that the groove 45 is located on the cap 40 and the ridge 46 is located on the head 12.

Referring now to FIG. 6, a cross-sectional schematic of the head portion 12 of the toothbrush 10 of FIG. 5 is illustrated. The annular ridge 46 of the cap 40 extends inward from the inner surface 42 of the cap 40 and is located along the inner periphery of the bottom edge of the cap 40. The annular groove 45 is formed into the peripheral surface of the head 12. When the cap 40 is attached to the head 12, the annular ridges 46 snap-fits into and mates with the annular groove 45, thereby securing the cap 40 to the head 12.

In a preferred embodiment, the distal tips 27 of the tooth cleaning elements 26 are adjacent a roof 44 of the cap 40. In a more preferable embodiment, the cap 40 will be designed so that the distal tips 27 of the tooth cleaning elements 26 are separated from the bottom surface of the roof 44 by a space between 0-5 millimeters. In a most preferable embodiment, the inner surfaces of the cap 40 will be spaced from the tooth cleaning elements 26 by a space between 1-5 millimeters in all directions. This configuration maintains the portability of the toothbrush 10 by ensuring that the toothbrush 10, even with the cap 40 assembled thereto, maintains its small profile. In addition to protecting the dispenser against premature moisture degradation, the cap 40 will also protect the tooth cleaning elements 26 and dispenser 32 against physical damage. The cap 40 further protects the tooth cleaning elements 26 and dispenser 32 against dust, dirt, and the like that may be present in the air.

Figure 7:
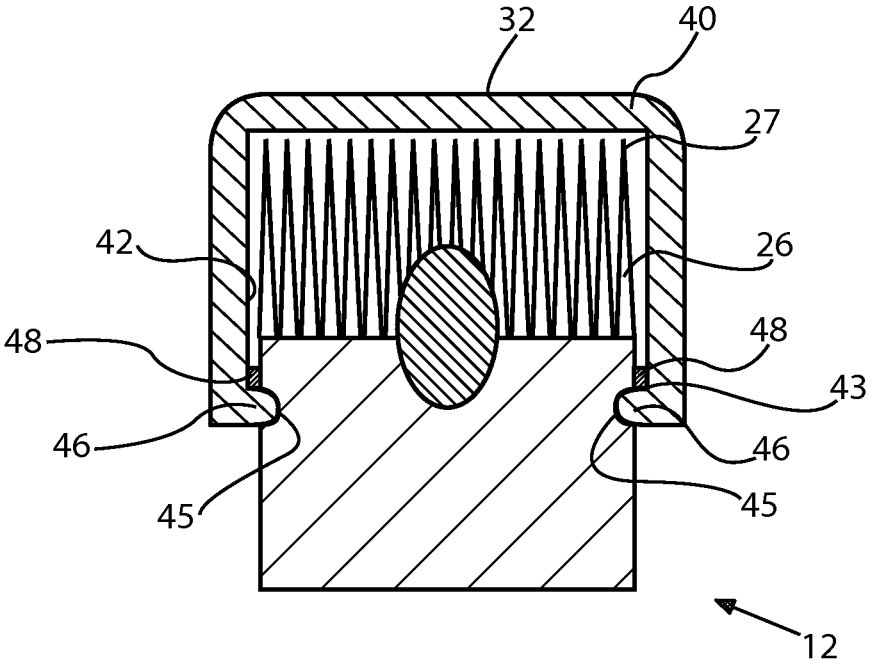
FIG. 7 is a cross-sectional schematic of a head portion of an oral care implement with a cap attached thereto in accordance with a second embodiment of the present invention.
Figure 8:
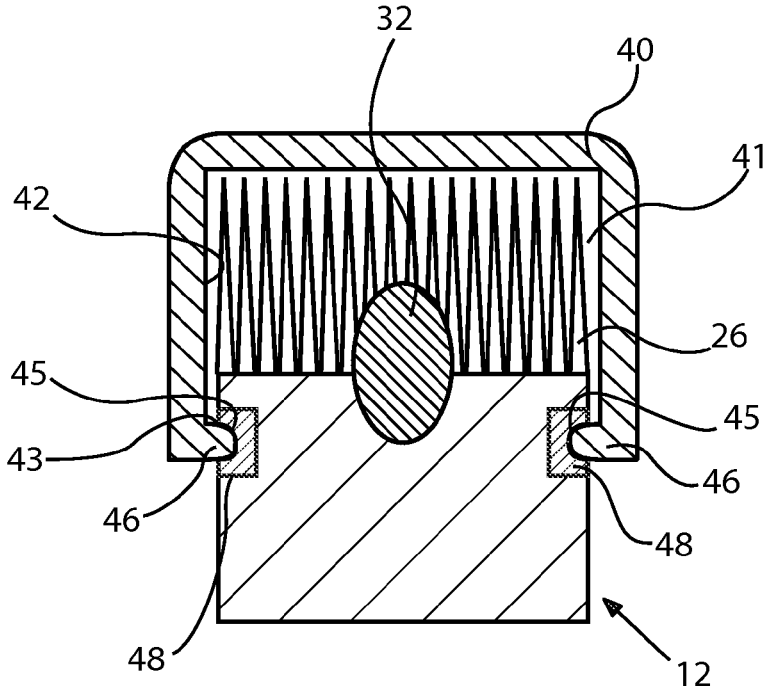
FIG. 8 is a cross-sectional schematic of a head portion of an oral care implement with a cap attached thereto in accordance with a third embodiment of the present invention.
Figure 9:
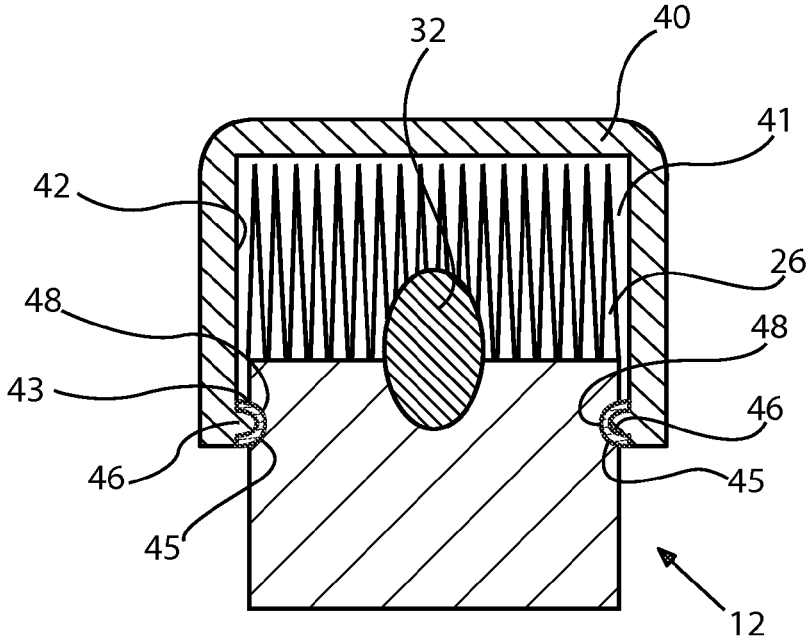
FIG. 9 is a cross-sectional schematic of a head portion of an oral care implement with a cap attached thereto in accordance with a fourth embodiment of the present invention.

FIGS. 7-9 illustrate alternative embodiments of air-tight attachments between the head 12 and the cap 40. Referring first to FIG. 7, the air-tight seal 43 is formed by the inclusion of a gasket 48 that is compressed between the inner surface 42 of the cap 40 and a portion of the head 12 of the toothbrush 10. In this exemplified embodiment, the gasket 48 is connected to and forms a portion of the cap 40. However, the invention is not so limited and the gasket 48 may be connected to or integrated into the head 12. Additionally, the gasket 48 may be a separate component that is positioned between the head 12 and the cap 40 during the assembly process.

As with the embodiment of FIG. 6, the cap 40 is structurally secured to the head 12 through the mating of the ridge 46 and the groove 45. The gasket 48 is positioned so that it is adjacent to and/or sits directly above the groove/ridge 45, 46 attachment between the head 12 and the cap 40. The gasket 48 is preferably a ring made of elastomeric material, such as one of the thermoplastic elastomers discussed above, so that it is able to be compressed between the inner surface 42 of the cap 40 and the head 12. Alternatively, the gasket 48 can be formed of a low density thermoplastic. The gasket 48 may be a separate piece, or it may be co-molded with either the cap 40 or the head 12 to form a single, unitary structure. In another embodiment, the gasket 48 may be conceptually created by virtue of a groove being formed into the elastomeric material of the cleaning element block 22. Regardless of the specific connection between the gasket 48, the head 12 and the cap 40, the gasket 48 is preferably compressed between the cap 40 and the head 12 to create the air-tight annular seal 43.

Again, due to the air-tight nature of the attachment between the cap 40 and the head 12, which is accomplished by the air-tight seal 43, the atmosphere outside of the air-tight chamber 41 cannot penetrate into the air-tight chamber 41. This enables the toothbrush 10 to be brought into a high humidity environment without affecting the low humidity environment within the air-tight chamber 41.

Referring to FIG. 8, an embodiment of the invention is illustrated wherein the gasket 48 is created by the formation of elastomeric annular ring about the periphery of the head 12. In this embodiment, the elastomeric material that forms the gasket 48 partially fills an annular channel formed into the periphery of the head 12. Alternatively, the gasket 48 may be formed as a unitary part of the head 12. The gasket 48 comprises the annular groove 45. When the cap 40 is secured to the head 12, the annular ridge 46 of the cap 40 mates with the annular groove 45 that is formed into the gasket 48. Because the gasket 48 is made of an elastomeric material, the annular ridge 46 of the cap 40 is able to compress the gasket 48 when the cap 40 is secured to the head 12 so as to form the air-tight annular seal 43. In this manner, the mating of the ridge 46 and the groove 45 both form the air tight seal 43 and structurally secure the cap to the head 12. While in the exemplified embodiment the gasket 48 has a groove formed therein that mates with the ridge 46 of the cap 40 to form the air-tight seal 43, it is possible that the compressed fit between the ridge 46 of the cap 40 and the gasket 48 alone is capable of creating the necessary air-tight seal 43 (without the groove).

Referring to FIG. 9, an embodiment of the invention is exemplified wherein the gasket 48 is attached directly to the annular ridge 46 of the cap 40. The gasket 48 may connected to the annular ridge 46 or it may be integrally formed therewith. When the cap 40 of FIG. 9 is attached to the head 12, the annular ridge 46 of the cap 40 (in conjunction with the gasket 48), fits into and engages the annular groove 45 of the head 12, thereby concurrently forming the annular seal 43 and the structural connection between the head 12 and the cap 40.

Again, although all of the embodiments have been described herein with an annular groove 45 in the head 12 of the toothbrush 10 and an annular ridge 46 on the cap 40, the invention is not so limited. In any of the embodiments discussed herein, the head 12 of the toothbrush 10 may be provided with an annular ridge and the cap 40 may be provided with an annular groove. Moreover, the exact location of the groove and the ridge can be varied on the head 12 and/or the cap 40.

In further embodiments, the cap 40 may not cover the entirety periphery of the head 12. Rather, the cap 40 may be constructed so as to only cover the portion of the head 12 that contains the dispenser 32, such as the depression 28 of FIG. 4. In such an embodiment, the bottom edge of the cap 40 can engage the upper surface 25 of the head 12 and be located centrally on the head 12 and/or within the cleaning element field and surrounded by the cleaning elements 26.

Alternative configurations for the attachment between the head 12 and the cap 40 are also contemplated and within the scope of the invention. For example, the cap 40 may be attached to the head 12 via a press-fit attachment, tight-fit assembly, a snap-fit assembly, a threaded engagement, a tang snap assembly, a hook-and-loop fastener, and/or combinations thereof.

Referring back to FIGS. 5 and 5A, a method of assembling an oral care implement for distribution that protects the moisture sensitive dispenser 32 (and its moisture sensitive seal 34) against degradation will be described. The method includes providing the toothbrush 10 described above, which includes the moisture sensitive dispenser 32 (which comprises the moisture sensitive seal 34) that degrades when subjected to moisture. The method further includes placing the toothbrush 10 in a low humidity atmosphere and attaching the removable cap 40 to the head 12 so as to create the air-tight chamber 41 (which is formed by the inner surface 42 of the cap 40 and the head 12) about the dispenser 32. The air-tight chamber 41 is filled with air from the low humidity environment. In a preferable embodiment, the tooth cleaning elements 26 may also be disposed within the air-tight chamber 41. The toothbrush 10 may then be transported to a high humidity atmosphere without compromising the low humidity atmosphere within the air-tight chamber 41.

Due to the air-tight annular seal 43 between the cap 40 and the head 12 of the toothbrush 10, the air-tight chamber 41 will maintain its low humidity atmosphere, thereby protecting the dispenser 32 that is disposed therein against degradation due to moisture exposure. Prior to use of the toothbrush 10, the cap 40 may be removed manually.

Finally, while the invention is discussed above with respect to a rigid removable cap that forms an air-tight chamber, the invention is not so limited. In other embodiments, any type of moisture impermeable barrier can be used to protect the dispenser or oral care material from moisture degradation. Such moisture impermeable barriers may allow dry air to pass therethrough but would impermeable to liquid and vapor forms of water. Such moisture impermeable materials can be used to create different structures, including without limitation, the cap discussed above, a sheet of material that is attached to the head, a bag that encloses the head (or a portion thereof), and the like. In one embodiment, a flexible sheet or bag constructed of moisture impermeable material may be attached to the head to enclose the dispenser (or oral care material) in a moisture impermeable chamber. The flexible sheet or bag may be heat shrunk to create the necessary hermetic connection with the head or other part of the toothbrush to prevent moisture from entering the chamber via the interface between the flexible sheet or bag and the toothbrush structure.

In embodiments where the oral care material is incorporated into the tooth cleaning elements 26, rather than in an capsule or bead, the water impermeable barrier may be directly attached to and enclose the tooth cleaning elements 26. In such embodiments, the chamber 41 does not have to include free space but may be completely filled with the capsule and/or the tooth cleaning elements.

While a number of embodiments of the current invention have been described and illustrated in detail, various alternatives and modifications will become readily apparent to those skilled in the art without departing from the spirit and scope of the invention. As various changes could be made in the above methods, compositions and structures without departing from the scope of the invention, it is intended that all matter contained in this application, including all mechanisms and/or modes of interaction described above, shall be interpreted as illustrative only and not limiting in any way the scope of the appended claims.

What is claimed is:

1. An oral care implement comprising:
- a handle;
- a head connected to the handle;
- a plurality of tooth cleaning elements extending from a face of the head;
- a dispenser containing an oral care material positioned on the head, the dispenser being degradable when subjected to moisture;
- a removable cap attached to the head such that an inner surface of the cap and a portion of the head forms an air-tight chamber;
- an elastomeric gasket compressed between the head and the cap so as to form an air-tight annular seal when the cap is attached to the head; and
- wherein the dispenser is disposed within the air-tight chamber.

2. The oral care implement of claim 1, wherein the dispenser is disposed within a socket on the face of the head.

3. The oral care implement of claim 2, wherein the dispenser and the removable cap are surrounded by the plurality of tooth cleaning elements.

4. The oral care implement of claim 1, wherein the plurality of tooth cleaning elements are disposed within the air-tight chamber.

5. The oral care implement of claim 4, wherein the head comprises an annular groove around a periphery of the head, and wherein the cap comprises an annular ridge that mates with the annular groove of the head via a snap-fit connection.

6. The oral care implement of claim 1, wherein the cap is constructed of a hard plastic and the elastomeric gasket is attached to the cap.

7. The oral care implement of claim 1, wherein the cap is constructed of a hard plastic and the elastomeric gasket is co-molded with the cap.

8. The oral care implement of claim 1, further comprising:
- an annular groove on one of the inner surface of the cap or a periphery of the head;
- a ridge on the other one of the inner surface of the cap or the periphery of the head;
- the ridge mating with the groove via a snap-fit connection; and
- wherein the cap is constructed of a hard plastic.

9. The oral care implement of claim 1, further comprising:

an annular groove on one of the inner surface of the cap or a periphery of the head;

a ridge on the other one of the inner surface of the cap or the periphery of the head, the ridge mating with the groove via a snap-fit connection; and wherein one or more of the ridge and the groove is formed of an elastomeric material that forms the elastomeric gasket so that the mating of the ridge and the groove forms the air-tight annular seal.

10. The oral care implement of claim 1, wherein the dispenser is water soluble and tilled with a liquid oral care material.

11. An oral care implement comprising:

a handle;

a head connected to the handle;

a plurality of tooth cleaning elements extending from a face of the head;

a dispenser containing an oral care material, the dispenser being degradable when subjected to moisture;

a removable cap attached to the head such that an inner surface of the cap and a portion of the head forms an air-tight chamber, the air-tight chamber containing a low humidity atmosphere;

an annular groove on one of the inner surface of the cap or a periphery of the head;

a ridge on the other one of the inner surface of the cap or the periphery of the head, the ridge mating with the groove via a snap-fit connection;

wherein one or more of the ridge and the groove is formed of an elastomeric material so that the mating of the ridge and the groove forms an air-tight annular seal; and wherein the dispenser and the plurality of tooth cleaning elements are disposed within the low humidity atmosphere of the air-tight chamber.

12. The oral care implement of claim 11, wherein the dispenser comprises a water soluble shell.

13. The oral care implement of claim 11 wherein the low humidity atmosphere has a relative humidity level that is less than 70% at room temperature.

14. An oral care implement comprising:

a handle;

a head connected to the handle;

a plurality of tooth cleaning elements extending from a face of the head;

a dispenser containing an oral care material, the dispenser being degradable when subjected to moisture;

a removable cap attached to the head such that an inner surface of the cap and a portion of the head forms an air-tight chamber, the air-tight chamber containing a low humidity atmosphere;

wherein the dispenser and the plurality of tooth cleaning elements are disposed within the low humidity atmosphere of the air-tight chamber;

an annular groove on one of the inner surface of the cap or a periphery of the head;

a ridge on the other one of the inner surface of the cap or the periphery of the head, the ridge mating with the groove via a snap-fit connection;

a gasket compressed between the head and the inner surface of the cap so as to form an air-tight annular seal when the cap is attached to the head; and wherein the cap is constructed of a hard plastic.

15. The oral care implement of claim 14, wherein the gasket is co-molded with the cap.

16. A method of assembling an oral care implement for distribution comprising:

providing an oral care implement comprising a handle and a head connected to the handle and a plurality of tooth cleaning elements extending, from a face of the head;

providing a dispenser containing an oral care material on the head of the oral care implement, the dispenser being degradable when subjected to moisture; and attaching a removable cap to the head in a low humidity atmosphere such that an inner surface of the cap and a portion of the head forms an air-tight chamber, the air-tight chamber filled with the low humidity atmosphere and the dispenser disposed within the air-tight chamber.

17. The method of claim 16, further comprising transferring the oral care implement to a high humidity atmosphere, the cap maintaining the low humidity atmosphere within the air-tight chamber until the cap is removed from the head of the oral care implement.

18. The method of claim 16, wherein the plurality of tooth cleaning elements are disposed within the air-tight chamber.

19. The method of claim 16, wherein one or more of the dispenser and the cap is surrounded by the plurality of tooth cleaning elements.

20. An oral care implement comprising:

a handle;

a head connected to the handle, the head comprising a rigid portion and an elastomeric cleaning element block, a bottom surface of the elastomeric cleaning element block coupled to a top surface of the rigid portion;

a plurality of tooth cleaning elements unitarily formed with the elastomeric cleaning element block, the plurality of tooth cleaning elements extending from a face of the head;

a dispenser containing an oral care material positioned on the head, the dispenser being degradable when subjected to moisture;

a removable cap attached to the head so as to create an air-tight chamber between an inner surface of the removable cap and a portion of the head, the removable cap being constructed of a moisture impermeable material;

an annular groove formed into the rigid portion of the head adjacent to the bottom surface of the elastomeric cleaning element block, the removable cap having a ridge that mates with the annular groove via a snap-fit connection, the bottom surface of the elastomeric cleaning element block forming a gasket-type fit with the removable cap to create the air-tight chamber; and wherein the dispenser is disposed within the air-tight chamber.

21. The oral care implement of claim 20, wherein the removable cap forms a hermetic seal with the head.

22. The oral care implement of claim 20, wherein the dispenser comprises a water soluble shell and the oral care material is hydrophobic.

* * * * *